US007111549B2

(12) United States Patent
Daniel

(10) Patent No.: US 7,111,549 B2
(45) Date of Patent: Sep. 26, 2006

(54) T-GIB DYNAMIC BALANCER WEIGHT GUIDE

(75) Inventor: Edward A. Daniel, Ft. Loramie, OH (US)

(73) Assignee: The Minster Machine Company, Minster, OH (US)

( * ) Notice: Subject to any disclaimer, the term of this patent is extended or adjusted under 35 U.S.C. 154(b) by 0 days.

(21) Appl. No.: 10/163,278

(22) Filed: Jun. 5, 2002

(65) Prior Publication Data

US 2003/0024295 A1 Feb. 6, 2003

Related U.S. Application Data

(60) Provisional application No. 60/296,930, filed on Jun. 9, 2001.

(51) Int. Cl.
*B30B 1/00* (2006.01)

(52) U.S. Cl. ..... 100/249; 100/254; 100/257; 100/266; 100/280

(58) Field of Classification Search ..... 100/214, 100/258 R, 249, 251, 255, 257, 265, 266, 100/254, 280; 72/456; 384/39, 42, 105–115, 384/100, 101, 118, 121, 123
See application file for complete search history.

(56) References Cited

U.S. PATENT DOCUMENTS

| | | | | | |
|---|---|---|---|---|---|
| 2,321,741 | A | * | 6/1943 | Flowers | 384/39 |
| 2,532,320 | A | | 12/1950 | Maussnest | 113/42 |
| 2,914,362 | A | * | 11/1959 | Ott et al. | 384/40 |
| 3,020,097 | A | | 2/1962 | Bullard et al. | 308/3 |
| 3,568,498 | A | * | 3/1971 | Pearson | 72/456 |
| 3,611,918 | A | | 10/1971 | Marsh et al. | |
| 3,619,013 | A | * | 11/1971 | Jones | 384/12 |
| 3,675,976 | A | | 7/1972 | Carrieri et al. | |
| 3,903,993 | A | | 9/1975 | Vorrhees et al. | |
| 4,065,954 | A | | 1/1978 | Gotz | |
| 4,321,819 | A | * | 3/1982 | Kraft et al. | 72/456 |
| 4,375,785 | A | | 3/1983 | Schoch et al. | |
| 4,376,410 | A | | 3/1983 | Wissman et al. | |
| 4,397,232 | A | | 8/1983 | Schockman et al. | |
| 4,475,278 | A | * | 10/1984 | Schockman et al. | 29/434 |
| 4,542,674 | A | | 9/1985 | Omo, Jr. | |
| 4,606,587 | A | | 8/1986 | Thompson | |
| 4,674,357 | A | | 6/1987 | Sugawara et al. | |
| 5,136,875 | A | | 8/1992 | Schockman | |
| 5,182,935 | A | | 2/1993 | Schockman | |
| 5,609,099 | A | * | 3/1997 | Burns et al. | 100/257 |
| 5,775,212 | A | * | 7/1998 | Takao | 100/214 |
| 6,070,523 | A | * | 6/2000 | Burns et al. | 100/282 |

* cited by examiner

*Primary Examiner*—Derris H. Banks
*Assistant Examiner*—Shelley Self
(74) *Attorney, Agent, or Firm*—Randall J. Knuth

(57) ABSTRACT

A guide system is provided to slidingly guide a reciprocating dynamic balancer weight within a press machine. An elongate stationary guide rail is disposed within a vertical channel formed at one side of the balancer mass. In this configuration, the guide rail is arranged in guide support relationship to the balancer mass. An arrangement of wear plates is mounted to the guide rail to provide additional bearing support to the reciprocating balancer mass. An arrangement of hydrostatic pads is mounted to the guide rail in facing opposition to the balancer mass to enable the formation of a hydrodynamic/hydrostatic lubricating action therebetween during reciprocation of the balancer mass. A machined steel plate is secured to the balancer mass at the same side where the guide rail is located and includes a set of lateral apertures formed therethrough that receive guide support members extending therethrough. The guide support members anchor the guide rail to the press crown.

42 Claims, 5 Drawing Sheets

T-GIB DYNAMIC BALANCER WEIGHT GUIDE

RELATED APPLICATIONS

This application claims domestic priority to U.S. Provisional Application No. 60/296,930, filed Jun. 9, 2001, the content of which is hereby respectfully incorporated by reference thereto.

BACKGROUND OF THE INVENTION

1. Field of the Invention

The present invention relates to a press machine environment, and, more particularly, to a guide system for use in providing slide-type guiding support to a reciprocating dynamic balancer weight.

2. Description of the Related Art

Mechanical presses of the type performing stamping and drawing operations have a conventional construction comprising a crown and a bed portion configured within a frame structure. A slide supported within the frame is adapted for reciprocating movement toward and away from the bed. The slide is driven by a crankshaft having a connecting arm coupled to the slide. These mechanical presses are widely used for a variety of workpiece operations employing a diverse array of die sets, with the press machine varying substantially in size and available tonnage depending upon its intended use.

In a conventional arrangement, the frame structure is formed and/or integrated with a gib apparatus having a known function and configuration. For example, in a typical machine configuration, the frame includes a set of upright support members (e.g., four) extending between the crown and bed at respective corner locations. Transverse cross-beams are used to provide a connection between a pair of same-side uprights. At the upper portion of each upright, a gib member is employed in a known manner to provide guidance-type bearing support to the slide. For example, the gib member includes an engagement surface that is adapted for full surface-to-surface abutting contact with a corresponding surface on the slide or a coupling piece secured to the slide.

Various approaches have been taken to reduce, dampen or otherwise minimize the vibrations generated by the inertial forces associated with the reciprocating movement of the slides and upper dies. In one arrangement, the press machine is adapted to include a balancer mass device that reciprocates in a manner relative to the slide and die configuration so as to counteract the inertial forces generated by the reciprocating slide. In effect, the balancer device serves as a counterbalance against the moving slide. As a result, the vertically-directed inertia forces creating the vibrations are reduced by an opposing vertical inertia force produced by the balancer device, thereby reducing the vibrations.

The balancer device is typically driven by the same rotary components that power the reciprocating movement of the slide, namely, the crankshaft. For this purpose, the crankshaft would include a suitable connection assembly for mounting and otherwise coupling the balancer device to the crankshaft.

As with the slide, the press machine must likewise provide some form of gib-type frame for locating and otherwise guiding the reciprocating movement of the balancer in order to maintain the precise counterbalancing relationship between the slide and balancer device. Any misalignment or disruption in the travel of the balancer device will impair the counterbalancing relationship and thereby diminish its effectiveness in reducing the vibrational activity.

The gib structure for the massive balancer device must be carefully constructed because the same operational and environmental concerns that are addressed in designs for slides gibs are also a factor with balancer gib constructions. For example, thermally-induced clearance close-outs remain a serious issue as it relates to the elimination of clearance spaces between the balancer device and any bearing surfaces of the balancer frame. Otherwise, any undue expansion in the bearing surfaces may cause the frame to interfere with and retard the reciprocating travel of the balancer mass.

A need therefore exists to provide a gib frame for the balancer mass that provides optimal guiding support in terms of minimizing the thermally-induced close-out effect that is potentially experienced by the bearing surfaces.

SUMMARY OF THE INVENTION

A guide system is provided for use in guiding the reciprocating motion of a dynamic balancer weight within a mechanical press machine.

The guide system includes a guide rail provided in the form of an elongate stationary member registered within a vertical channel formed at one side of the dynamic balancer weight. The channel may be formed by milling, for example. The guide rail serves to locate and otherwise guide the reciprocating motion of the dynamic balancer weight. A plurality of wear plates is mounted to the guide rail to provide additional bearing support to the reciprocating balancer mass.

The guide system further includes a machined steel plate that is secured to the balancer mass at the same side where the guide rail is located. The machined steel plate is provided with at least two apertures or slots formed therethrough that define lateral passageways enabling access to the guide rail. A set of guide support members extends transversely through the steel plate apertures. The guide support members serve to fixedly locate the guide rail by attaching the guide rail to the press crown.

An arrangement of hydrostatic pad areas is mounted to the guide rail in facing opposition to the balancer mass. The hydrostatic pads enable a hydrodynamic lubricating action to be developed between the moving balancer mass and the stationary pads during operative reciprocation of the balancer mass.

Any form of drive system may be used to impart a reciprocating motion to the balancer mass, such as a connecting rod or scotch yoke drive.

An auxiliary guide support is optionally provided to inhibit the balancer weight from pivoting about the guide rail. For this purpose, the auxiliary guide supports are disposed on the side of the balancer weight opposite the guide rail.

The invention, in one form thereof, is directed to a guide system for use with a movable balancer in a machine environment. The guide system comprises, in combination, a stationary guide rail disposed in guiding relationship to the balancer and at least one wear plate secured to the guide rail. Each wear plate is disposed in facing relationship to the balancer.

In one form, the balancer is adapted to include a channel formed therein at one side thereof. The guide rail is receivingly disposed at least in part within the balancer channel. Additionally, each wear plate is suitably arranged to provide bearing support to the balancer.

The guide system further includes at least one hydrodynamic bearing secured to the guide rail. At least one of the hydrodynamic bearings is disposed in facing relationship to the balancer. Each hydrodynamic bearing further includes a pad having a recess formed therein at a side thereof facing the balancer. A means is provided to supply fluid to the respective recess of each respective pad. The fluid supply means includes at least one fluid passageway formed in the guide rail.

The guide system further comprises a means to connect the guide rail to a crown portion of a press machine in the machine environment. In one form, the connection means includes a plate member that is secured to a side of the balancer common with the location of the guide rail. The plate member includes at least one aperture formed therethrough. The connection means also includes at least one rail support member each extending through a respective plate member aperture and providing a connection between the guide rail and the crown portion.

The invention, in another form thereof, is directed to a system for use with a movable balancer in a machine environment. The system comprises, in combination, a stationary guide member and at least one bearing support member attached to the guide member. The guide member is arranged to provide operative guiding support to the balancer. In particular, the guide member operatively slidingly guides the balancer. Each bearing support member is disposed in bearing support relationship to the balancer.

In one form, the balancer has a portion defining a channel, enabling the guide member to be receivingly disposed at least in part within the balancer channel. The balancer channel preferably extends at least in part in a direction substantially parallel with a direction defining a path of movement of the balancer.

In another form, the guide member includes an upright elongate portion which extends at least in part along a dimension substantially parallel with a dimension defining a path of travel for the balancer. This upright elongate portion of the guide member is disposed at least in part within a vertical channel defined in the balancer. This vertical balancer channel is preferably formed at a side of the balancer.

In yet another form, the guide member has at least one portion defining a rail-type configuration. Additionally, each bearing support member includes a respective plate element mounted to the guide member rail.

The system further includes at least one hydrodynamic bearing each secured to the guide member and disposed in facing relationship to the balancer. Each hydrodynamic bearing further includes a pad having a recess formed therein at a side thereof facing the balancer. There is provided a means to supply fluid to the respective recess of each respective pad. This fluid supply means includes at least one fluid passageway formed in the guide member.

The guide member, in another form thereof, has a first side surface and a second side surface disposed opposite one another. In a preferred configuration, each bearing support member is mounted to a respective one of the first and second side surfaces of the guide member. Moreover, each hydrodynamic bearing is mounted to the guide member at a respective surface thereof which extends between the first side surface and the second side surface thereof.

The system further includes a means to connect the guide member to a crown portion of a press machine in the machine environment. In one arrangement, the connection means comprises a plate member secured to a side of the balancer common with the location of the guide member. The plate member includes at least one aperture formed therethrough. The connection means further comprises at least one guide support member. Each such guide support member is adapted to extend through a respective plate member aperture and provide a connection between the guide member and the crown portion.

In a preferred form, the machine environment (e.g., press machine) is adapted to enable simultaneous removal of the guide member and the at least one bearing support member as an integral unit.

The system optionally includes at least one auxiliary guide element disposed at a side of the balancer opposite the guide member. Each auxiliary guide element is adapted to provide guiding support to the balancer.

The invention, in another form thereof, is directed to a system for use with a movable balancer in a machine environment. The system comprises, in combination, a guide means for guiding operative movement of the balancer and a bearing means for providing bearing support to the balancer. The guide means includes an elongate guideway. The bearing means is attached to the guide means. In a preferred form, the machine environment includes a press machine.

The balancer, in one form thereof, is adapted to include a vertical channel formed therein, enabling the elongate guideway of the guide means to be disposed at least in part within the balancer vertical channel.

The bearing means, in one form thereof, includes a plurality of plate members mounted to the guide means.

The system further includes a plurality of hydrodynamic bearing elements mounted to the guide means. Each hydrodynamic bearing element includes a pad having a recess formed therein at a side thereof facing the balancer. A fluid supply assembly is arranged to provide fluid to the plurality of hydrodynamic bearing elements.

The invention, in another form thereof, is directed to an apparatus for use with a movable balancer in a press machine. The apparatus comprises a guide rail in combination with a plurality of plate elements. The guide rail is disposed at least in part within a vertical channel defined by the balancer. Each plate element is mounted to the guide rail in facing opposition to the balancer. In a preferred configuration, the balancer is operatively slidingly guided by the guide rail.

The apparatus, in one form thereof, further includes a plurality of hydrodynamic bearing elements each mounted to the guide rail in facing opposition to the balancer. Moreover, each plate element respectively includes at least one bearing surface each arranged in bearing support relationship to said balancer.

The invention, in yet another form thereof, is directed to an apparatus for use with a movable balancer in a press machine. The apparatus includes a guide rail in combination with a plurality of plate elements. The balancer is disposed in slidingly guidable relationship to the guide rail. Additionally, each plate element is mounted to the guide rail in facing opposition to the balancer.

In a preferred form, the guide rail is disposed at least in part within a vertical channel defined by the balancer.

The apparatus further includes a plurality of hydrodynamic bearing members each mounted to the guide rail in facing opposition to the balancer. Moreover, each plate element respectively includes at least one bearing surface each arranged in bearing support relationship to said balancer.

One advantage of the present invention is that thermally-induced clearance close-out between the balancer and crown and between the balancer and balancer guide system is minimized since the guide rail support need only be provided at one side of the balancer.

Another advantage of the present invention is that the bearing apparatus mounted to the guide rail (namely, the hydrostatic bearing pads and wear plates) provide stable bearing support to the balancer.

Another advantage of the invention is that the bearing apparatus mounted to the guide rail can be removed as an assembly from the balancer weight without removing the balancer weight itself for inspection and repair of the guiding plate elements.

Yet another advantage of the present invention is that the guide supports need not be accurately mounted in relation to each other right to left, only front to back, thereby requiring less stringent manufacturing tolerances.

Another advantage of the inventions is that the major contribution to balancer guiding is accomplished from one side and a duplicated guiding system on the other side of the balancer weight is not required thus reducing manufacturing costs.

Another advantage of the present invention is that the bearing apparatus mounted to the guide rail can be removed as an assembly from the balancer weight, without removing the balancer weight itself, for inspection and repair of the guiding plate element.

Another advantage of the present invention is that the guide supports need not be accurately mounted in relation to each other in a right-to-left manner, only needing to be accurately positioned relative to the front-to-back alignment thereof, thereby requiring less stringent manufacturing tolerances.

Another advantage of the present invention is that the major contribution to balancer guiding is accomplished from one side and a duplicate guiding system on the other side of the balancer weight is not required, thus reducing manufacturing costs.

Another advantage of the invention is that any press machine environment can be adapted or otherwise retrofitted for installation of the guide rail support system by simply machining a suitable guideway channel into the existing balancer weight.

Another advantage is that the wear plate/guide rail assembly can be removed as a unit, allowing all bronze wear plates to be serviced once the guide rail is removed. Several of the wear plates are identical and can be interchanged in a service situation.

Another advantage is that there are no wear plate keyways in the balancer to keep in-line with each other and thereby introduce a potential index error when machining.

Another advantage is that the associated guide clearances are independent of the size of the crown and balancer and are machined-in and are thereby constant.

Another advantage is that lubrication for the wear plates is provided through the fixed rail support at the crown, in which there are no moving hoses and that each orifices is integral with its associated wear plates.

Another advantage is that machining on one-half of the crown is eliminated. All machining for the fixed guide rail is on the rear of the press (could be mounted on the front as well).

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
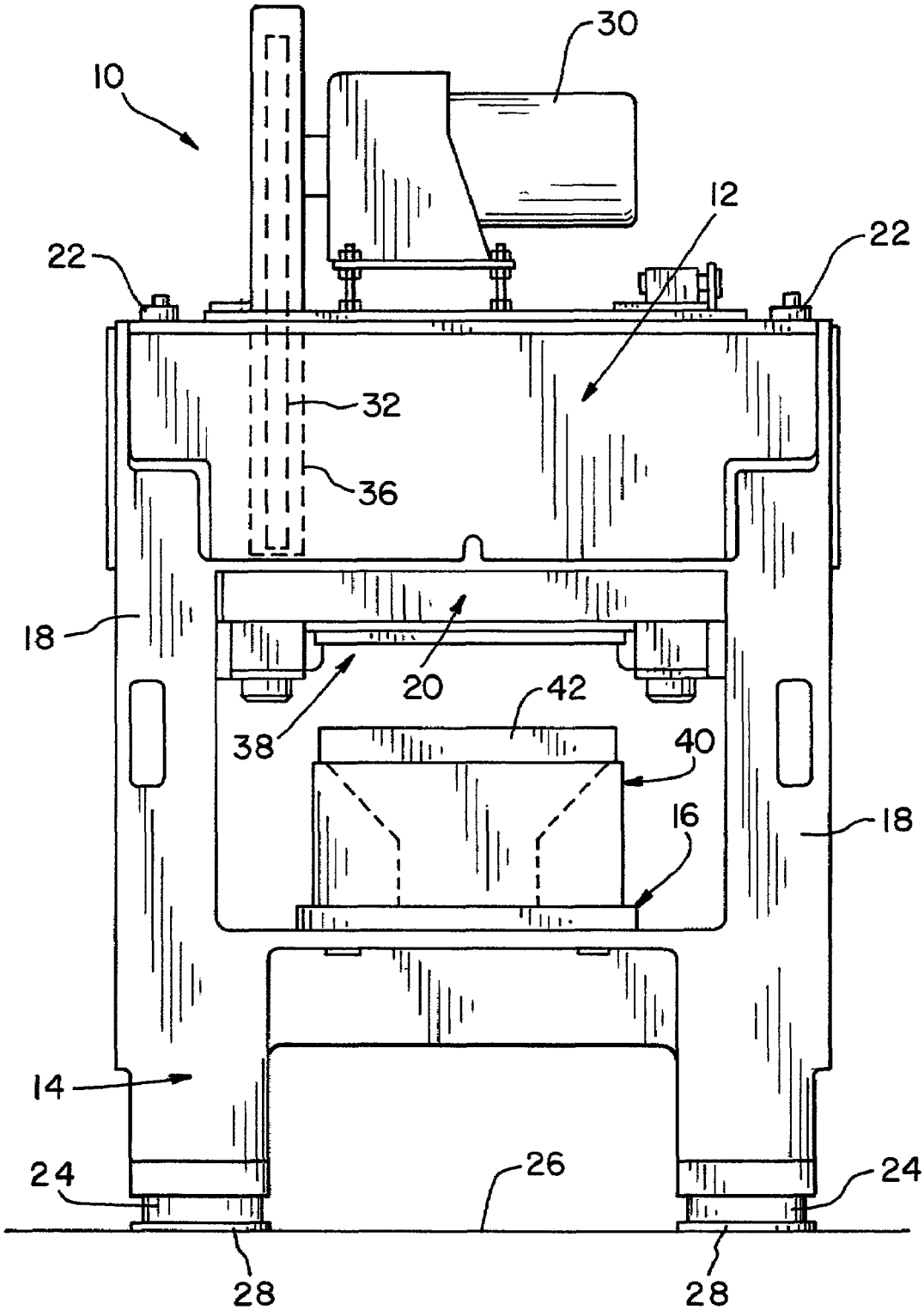
FIG. 1 is a front elevational view of one illustrative press machine capable of incorporating the balancer weight guide system of the present invention.

The balancer weight guide system of the present invention may be incorporated into machines of the mechanical press type discussed previously. Referring to FIG. 1, there is shown one such mechanical press 10 of conventional form including a crown portion 12, a bed portion 14 having a bolster assembly 16 connected thereto, and uprights 18 connecting crown portion 12 with bed portion 14. Uprights 18 are connected to or integral with the underside of crown 12 and the upper side of bed 14. A slide 20 is positioned between uprights 18 for controlled reciprocating movement between crown 12 and bed 14.

Press machine 10 further includes an upper die shoe (referenced generally at 38) attached in a conventional manner to the lower end of slide 20. The upper die shoe 38 preferably includes a die element (not shown) attached thereto. A lower die shoe 40 having a die element 42 coupled thereto is attached in a conventional manner to the upper end of bolster 16. The upper and lower dies, as so arranged in their opposing spaced-apart relationship, cooperate in a known manner during press operation to process a workpiece disposed therebetween, e.g., mounted upon the lower die element 42. The upper and lower dies together constitute a die set or assembly. A plurality of guide posts (not shown) may be disposed between the upper die shoe 38 and lower die shoe 40 in a known manner.

Tie rods (not shown), which extend through crown 12, uprights 18 and bed portion 14, are attached at each end with tie rod nuts 22. Leg members 24 are formed as an extension of bed 14 and are generally mounted on shop floor 26 by means of shock absorbing pads 28. A drive motor 30, which is part of the press drive mechanism, is attached by means of a belt 32 to the main flywheel of the clutch/brake combination (depicted generally at 36).

Although press 10 is shown in a press-down configuration, it could alternately be constructed in a press-up configuration by arranging the press in an upside-down fashion. In this form, slide 20 would be connected to the lower unit instead of the upper unit, i.e., crown 12. If slide 20 is connected to the lower unit in such alternate press-up configuration, the lower unit would constitute the crown portion.

The form of the press machine shown in FIG. 1 is provided for illustrative purposes only, and therefore should not be considered in limitation of the present invention, as it should be apparent to those skilled in the art that the principles of the present invention may be practiced with, and incorporated into, various other machine configurations, including machine environments other than press applications.

Figure 2:
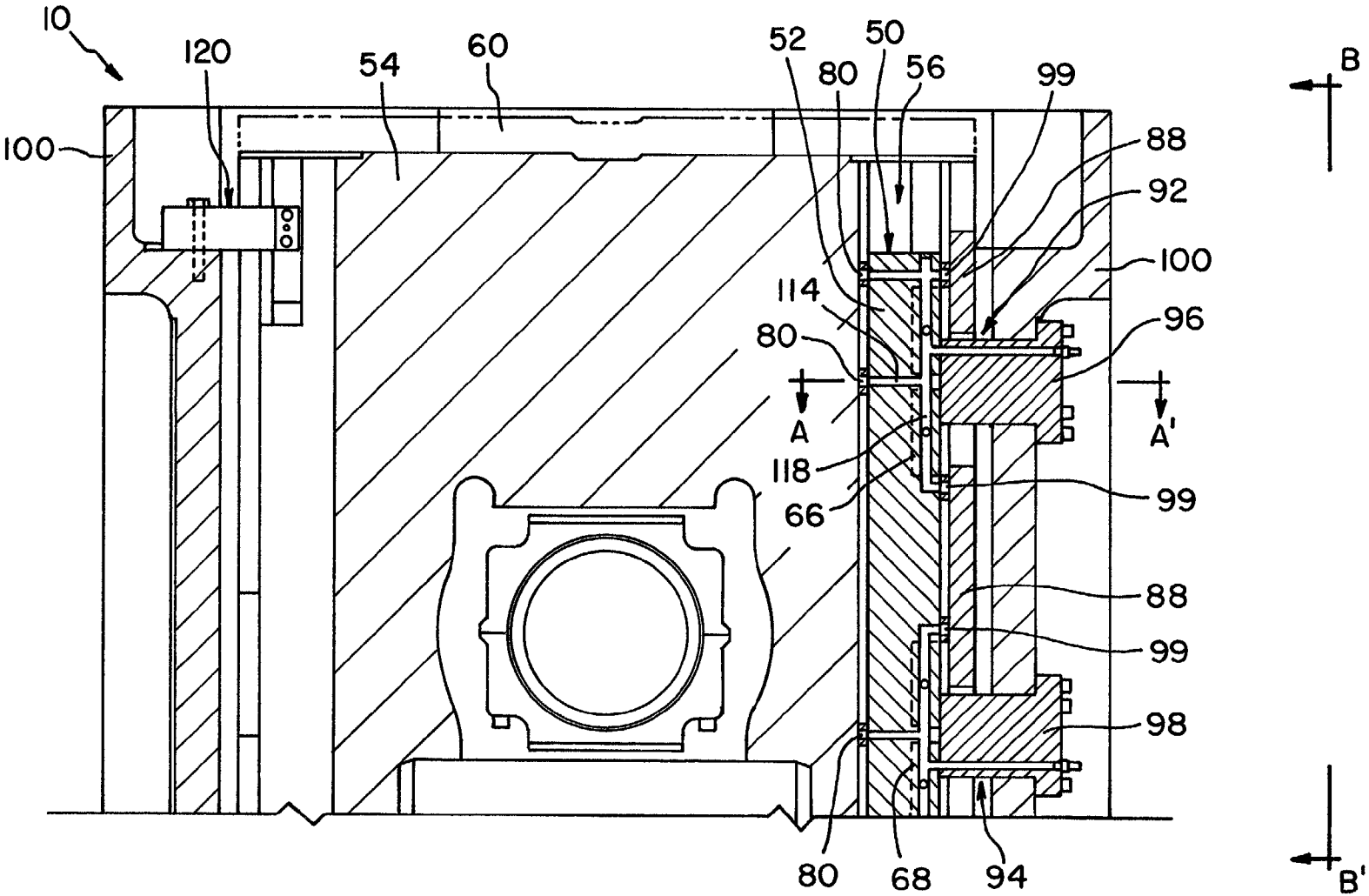
FIG. 2 is an upper elevational, sectional schematic, side-end planar view of a press machine for illustrating the guide system of the present invention, taken in partial cross-section through a vertical plane of a machine configuration utilizing a scotch yoke balancer drive assembly.
Figure 3:
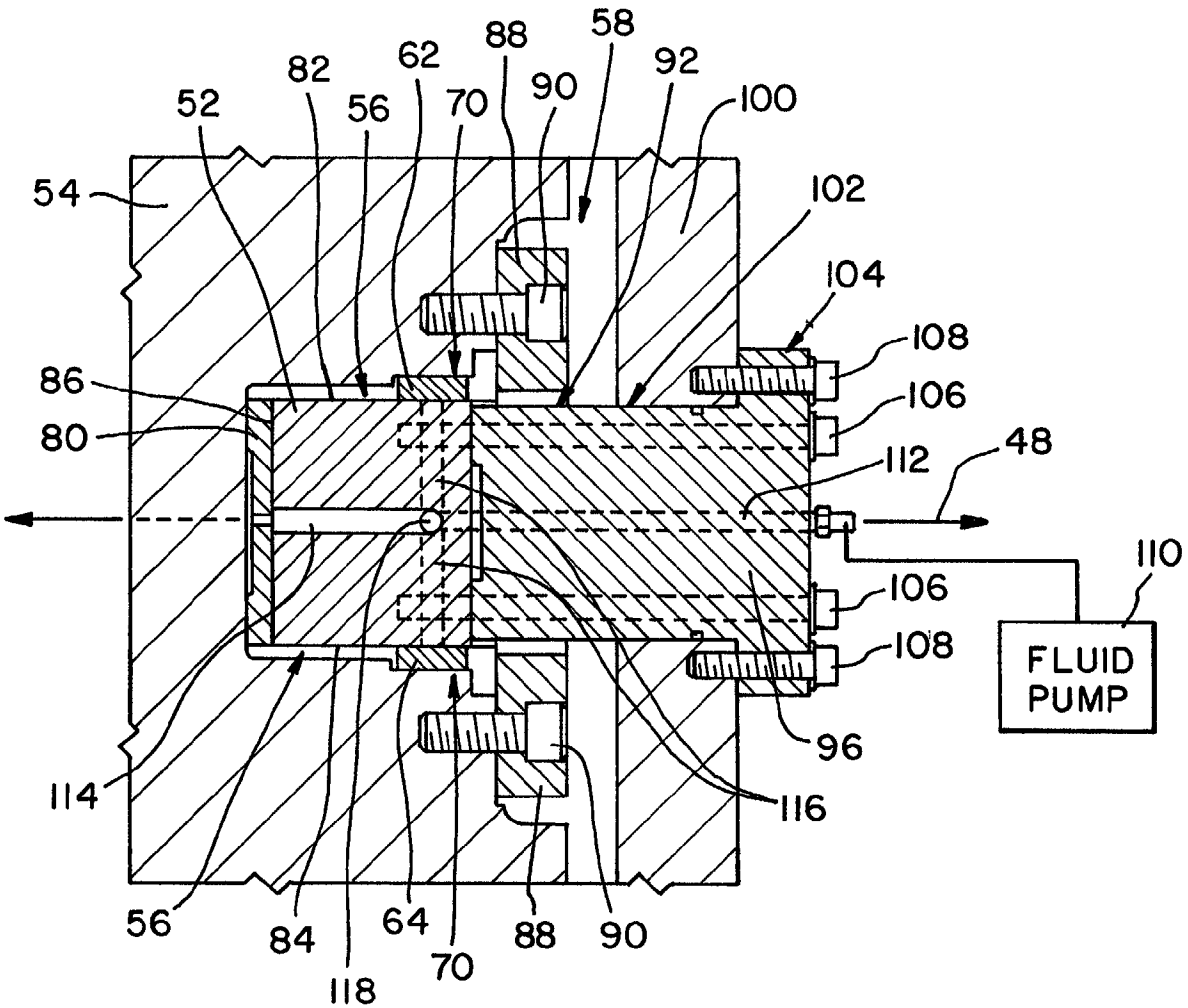
FIG. 3 is a partial, cross-sectional schematic, upper end planar view taken along lines A–A' in FIG. 2.

Referring now to FIG. 2, there is shown a partial cross-sectional view of a press machine 10 incorporating a guide assembly 50, according to one embodiment of the present invention. Reference is also made to FIG. 3, which schematically illustrates a cross-sectional view of guide assembly 50 taken along lines A–A' of FIG. 2. The view in FIG. 2 represents a partial cross-section taken through the vertical plane defined by line 48 in FIG. 3.

The illustrated guide assembly 50 includes a guide rail 52 for guiding the reciprocating movement of balancer mass 54. In particular, balancer 54 is arranged for slidable guiding support by guide rail 52. It should be apparent that guide assembly 50 may be adapted for use with any type of balancer mass. Illustrative examples of balancer mass designs may be found in U.S. Pat. No. 5,136,875, assigned to the same assignee as the present invention and incorporated herein by reference thereto.

The illustrated guide rail 52 generally defines a guideway structure that serves a channel or track-like function to controllably guide the linear movement of balancer 54. In one form, guide rail 52 may be configured as an elongate, upright, post or beam-type member that is positioned vertically within the machine environment. Generally, guide rail 52 will extend (at least in part) in a direction substantially parallel to the direction which defines the line of motion for balancer 54. Preferably, the guiding path defined by guide rail 52 will identically coincide with the path of linear translation for balancer 54.

Guide rail 52 preferably has a longitudinal dimension that extends sufficiently to accommodate the full range of reciprocation of balancer 54. Additionally, guide rail 52 has a generally rectangular cross-section. However, this configuration should not be considered in limitation of the present invention, as it should be apparent that any suitable geometry may be used for guide rail 52 consistent with its functionality in guiding balancer 54.

For purposes of locating guide rail 52 within the press machine environment, an improved installation strategy has been developed. In one form, a vertical channel (generally illustrated at 56) is defined within balancer 54 and is sufficiently dimensioned to receive guide rail 52 positioned therein. It is possible for vertical channel 56 to fully receive guide rail 52, although other designs may be used that enable some portions of guide rail 52 to extend laterally and/or longitudinally beyond vertical channel 56, if such a configuration is deemed advisable.

The illustrated vertical channel 56 is preferably formed in a side of balancer 54. In one configuration, vertical channel 56 has a generally U-shaped cross-section formed at a rear side of balancer 54. However, this feature should not be considered in limitation of the present invention, as it should be apparent that vertical channel 56 may be formed in any other suitable location within balancer 54. For example, vertical channel 56 may be formed at an interior of balancer 54.

In one alternate form, guide rail 52 can be arranged in guiding support relationship to balancer 54 without the formation of any channel within balancer 54. For example, guide rail 52 can be arranged in adjacent juxtaposition to balancer 54 and adapted to include a mechanism that engages it to balancer 54. For example, guide rail 52 can be adapted to include a race mechanism that receives a mating guide piece that is slidingly interfit within the track defined by the race mechanism. The guide piece would be affixed to balancer 54.

However, as discussed further, it is preferable to configure guide rail 52 within a vertical channel formed in balancer 54 since this configuration enables guide rail 52 to provide more accurate and better guiding stability due to the multi-sided bearing support that it can offer to the reciprocating balancer.

Referring again to FIGS. 2 and 3, the illustrated guide assembly 50 further includes a plurality of wear plates mounted to guide rail 52 and preferably arranged in opposing pairs 62, 64 disposed at opposite sides of guide rail 52. The relative position of the wear plates along guide rail 52 is shown in FIG. 2 as phantom outlines 66, 68. The phantom illustrations 66, 68 depict a configuration where the wear plates are spaced-apart along the length of guide rail 52 and preferably aligned with one another along the same longitudinal axis of guide rail 52.

In one form, wear plates 62, 64 define respective bearing support members that provide bearing support to balancer 54 and facilitate accurate slide-type guiding of balancer 54 along guide rail 52. In one arrangement, the wear plates 62, 64 are registered within respective recessed areas (depicted generally at 70) that are defined within balancer 54. This registration offers additional assistance in securely fixing and maintaining the location and position of guide rail 52 vis-à-vis balancer 54, namely, within vertical guide channel 56.

Any suitable means may be used to attach or otherwise secure wear plates 62, 64 to guide rail 52. Furthermore, any number of wear plates may be used. The wear plates may also be positioned in any manner suitable for providing the desired bearing support relationship with respect to balancer 54. For example, although wear plates 62, 64 are shown in FIG. 3 as being positioned towards the terminal edge of vertical guide channel 56, the wear plates may be arranged at a more interior location of vertical channel 56. Additionally, although only a single wear plate is shown at each longitudinal location, several wear plates may be assembled in serial relationship to one another at the same longitudinal position. In particular, a set of adjacent wear plates can be placed along a width-wise dimension of guide rail 52.

In one form, the illustrated hydrostatic bearing members or wear plates 62, 64 define a generally planar rectangular structure extending lengthwise along the longitudinal dimension of guide rail 52. Members 62 and 64 have hydrostatic pads built into them. However, this configuration should not be considered in limitation of the present invention, as it should be apparent that the wear plates may be provided in any suitable geometry and/or orientation. Any suitable material may be used to manufacture the wear plates, such as bronze.

For purposes of servicing guide assembly 50, the combination of guide rail 52 and hydrostatic bearing members or wear plates 62, 64 is considered a single unit that is integrally removed from the press machine. This feature has the advantage of enabling the wear plates to be replaced or serviced with significant ease since the necessary maintenance operations can be performed at a suitable facility and the balancer weight itself need not be removed from the press machine. Otherwise, it would be very difficult to render the appropriate maintenance to the wear plates while installed within the press machine.

The illustrated guide assembly 50 further includes an arrangement of hydrostatic bearing members 80, 99 mounted to guide rail 52 for providing additional bearing support to balancer 54. FIG. 2 depicts an illustrative arrangement of hydrostatic bearing members 80, 99 positioned along the length of guide rail 52. Any number and configuration of hydrostatic bearing members 80, 99 may be used.

Figure 3A:
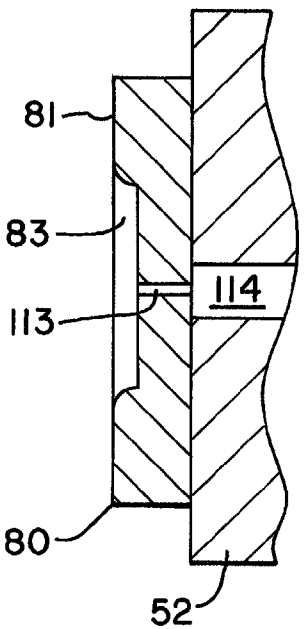
FIG. 3*a* is a view of the portion of FIG. 3 lying with the circle designated 3*a;*

In one illustrative arrangement, each hydrostatic bearing member 80, 99 is provided in the form of a pad element 81 (FIG. 3*a*) having a recess 83 formed therein at a side thereof facing balancer 54. In this manner, fluid can be supplied to the pad recesses to enable the formation of a hydrodynamic thin-film bearing between the bearing members 80, 99 and balancer 54 that provides a lubricating action as balancer 54 moves relative to stationary guide rail 52. As shown, at each longitudinal position of guide rail 52 where hydrostatic bearing members 80, 99 are located, it is preferable that the relevant pad elements extend substantially fully across the width-wise dimension of guide rail 52 to provide the most complete bearing support possible.

FIGS. 2 and 3 depict a bearing support arrangement illustratively comprising hydrostatic bearing members 80, 99 and hydrostatic bearing members or wear plates 62, 64. This arrangement provides stable bearing support that accurately guides balancer 54 since each surface of guide rail 52 that faces balancer 54 is provided with a bearing device. In particular, the lateral surfaces 82, 84 of guide rail 52 are respectively provided with wear plates 62, 64, while the inner surface 86 of guide rail 52 is provided with hydrostatic bearing members 80, 99. This multi-sided bearing support is more than adequate to handle the significant inertial energy that accompanies movement of the massive balancer 54.

Guide rail 52 is an operatively stationary structure having a fixed position at least during reciprocation of balancer 54, which as known occurs in conjunction with press machine operation. For this purpose, an anchoring mechanism is provided to fixedly locate guide rail 52. In particular, a machined steel plate 88 is mounted to balancer 54 and surrounds the T-gib guide rail 52 to keep balancer 54 from moving in the front-to-back direction 48. Any suitable mounting means may be used, such as bolts 90.

The machined plate 88 is provided with a plurality of apertures or slots formed therethrough that enable transverse access to guide rail 52. FIGS. 2 and 3 depict two such slots (generally illustrated at 92, 94), although any number of slots may be formed. Machined plate 88 is adapted to receive a respective guide support anchor coupling member 96, 98 that extends fully through respective plate apertures 92, 94 and provides a connection between guide rail 52 and crown portion 100.

In particular, the illustrated anchor member 96 includes a generally cylindrical body portion 102 extending through plate aperture 92 and positioned in abutment to an outer-facing surface of guide rail 52. Anchor member 96 also includes a head portion 104 integrally provided with cylindrical body portion 102. The anchor members 96 may be provided with any suitable geometry.

Anchor member 96 is attached to guide rail 52 using any suitable means (such as mounting bolts 106), while anchor member 96 is attached to the stationary crown portion 100 using any suitable means (such as mounting bolts 108). In this manner, the guide rail 52 is stationarily fixed by attachment to the press crown 100 via anchor coupling members 96.

During servicing, if guide rail 52 is to be removed, the anchor members 96 would first need to be detached from guide rail 52. However, this task would not be difficult since anchor members 96 and mounting bolts 106 are easily accessible from the rear side of the machine.

For purposes of providing any necessary bearing support between guide rail 52 and the machined steel plate 88, a plurality of hydrostatic bearing elements 99 are interposed therebetween. In one form, hydrostatic bearing elements 99 are mounted to guide rail 52 at a side thereof opposite the location of rail-balancer hydrostatic bearing members 80.

The illustrated guide assembly 50 is preferably provided with a fluid supply apparatus comprising a fluid pump 110 connected to a source of fluid (such as oil) and a conveyance means enabling the pressurized fluid supplied by pump 110 to be transported to the bearing elements mounted to guide rail 52, namely, hydrostatic bearing pads 80, 99 and hydrostatic bearing pads or wear plates 62, 64. Fluid pump 110 may be any suitable means capable of selectively providing a flow of pressurized fluid, such as a controllable valve device.

In one illustrative arrangement, the fluid transport mechanism includes a fluid channel 112 formed in guide support anchor member 96. Fluid channel 112 is suitably arranged in fluid communication with fluid channel 114 formed in guide rail 52. A sharp-edge orifice 113 (FIG. 3*a*) in the form of a 0.030 Ø drilled hole is integral with the wear plate. The distal end of fluid channel 114 supplies fluid to the orifice which opens into the space where hydrostatic bearing pads 80, 99 are located, enabling fluid to enter and fill the associated pad recesses.

Additionally, fluid channel 112 is suitably arranged in fluid communication with fluid passageways 116 formed in guide rail 52 to convey fluid to hydrostatic bearing pads or wear plates 62, 64. Any number of suitable connecting passageways 118 may be used to axially transport fluid through the interior of guide rail 52 and interconnect various hydrostatic bearing pad sites.

The advantage of utilizing such fluid channels formed in guide rail 52 and guide support anchor members 96 is that no rotary unions are needed to couple the fluid lines together, since these components are stationary throughout the normal operation of balancer 54. The illustrated fluid transport mechanism is shown for illustrative purposes only and should not be considered in limitation of the present invention, as it should be apparent that any other suitable means may be used to convey fluid to the desired hydrodynamic bearing sites.

Optionally, an auxiliary guide support mechanism 120 may be disposed at a side of balancer 54 opposite the location of guide rail 52 to inhibit pivoting or tipping of balancer 54 about guide rail 52. Any number of such mechanisms 120 may be used. The mechanisms are stationarily fixed to crown 100.

Figure 4:
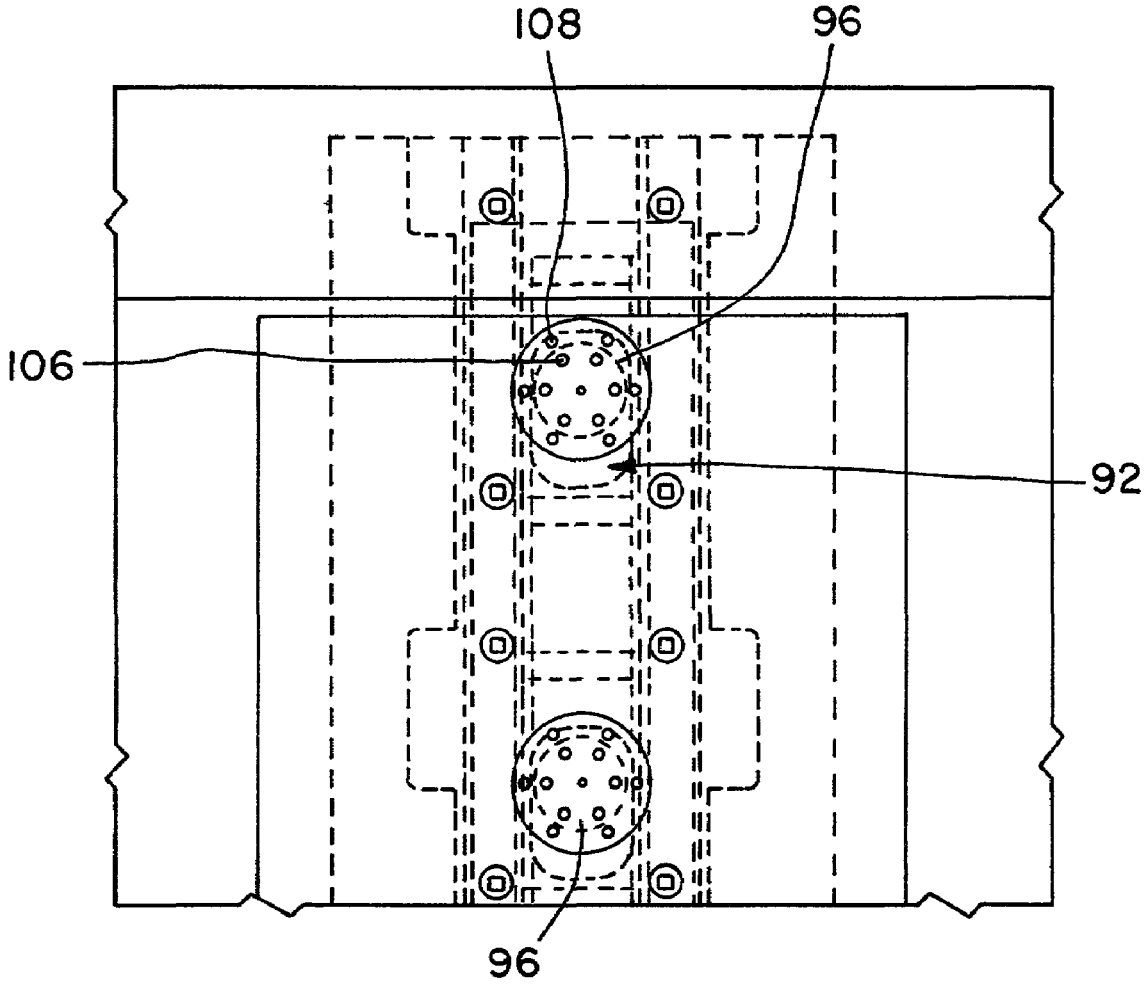
FIG. 4 is an upper elevational, sectional schematic, rear-end view taken along lines B–B' in FIG. 2.

Referring to FIG. 4, there is shown a partial schematic front view of the press machine taken along lines B–B' in FIG. 2 to depict an illustrative arrangement for the anchor member-to-guide rail mounting bolts 106 and the anchor member-to-crown mounting bolts 108.

Figure 5A:
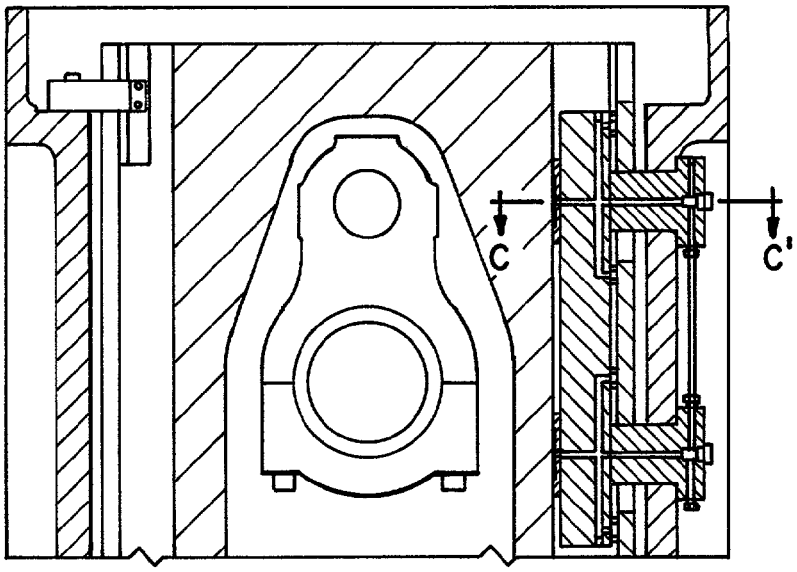
FIGS. 5A and 5B represent an upper elevational, sectional schematic, side-end view and a partial cross-sectional view of a press machine, respectively, for illustrating the guide system of the present invention, as implemented within another machine configuration utilizing a connection-driven balancer drive assembly.
Figure 5B:
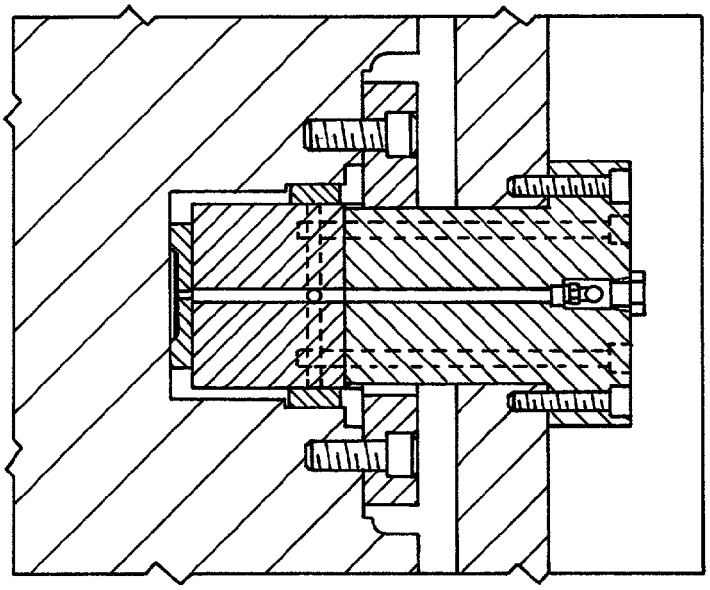

Referring to FIGS. 5A and 5B, there is respectively shown a side-end view and a cross-sectional view (taken along lines C–C' in FIG. 5A) of another press machine configuration utilizing the balancer guide system of the present invention.

A guide system similar to that associated with FIGS. 2–4 is deployed in FIGS. 5A and 5B. This machine configuration utilizes a connection drive as the driving mechanism for actuating movement of the dynamic balancer weight. However, any suitable balancer drive mechanism may be used without affecting the present invention.

The connection-drive design shown in FIGS. 5A and 5B has been shortened to put the centerline of the wrist pin even with the top rail support at stroke-up (2.23" or longest stroke). Even though the short connection may increase the side loading, the moment arm to the guide system has been minimized. Thereby, the balancer can expand right-to-left, front-to-back, and vertically without affecting the guide system, and guide clearances, expected to be 0.006" to 0.012" R-L & F-B, can be kept at a minimum for effective squeeze-film and hydrodynamic guiding.

What has been shown and described herein is a balancer guide system comprising several bronze wear plates fixed to a single stationary guide rail, which is attached to the crown (in one illustrative form) at two connection points. The balancer weight has an accurate guide channel machined on the rear side could be machined on the front as well. A machined steel plate attached to the balancer surrounds the T-gib guide rail and keeps the balancer from moving from front-to-back. Two slots in the machined steel plate allow for the attachment of the two rail supports to the stationary guide rail.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A guide system for use with a machine having a movable balancer, said guide system comprising:

a stationary guide rail being disposed with respect to said balancer in such a manner so as to thereby guide movement of said balancer; and at least one wear plate secured to said guide rail, at least one said wear plate being disposed in facing and bearing relationship to said balancer.

2. The guide system as recited in claim 1, wherein said guide rail being adapted and configured to enable location thereof within a balancer channel formed in said balancer.

3. The guide system as recited in claim 1, wherein said at least one wear plate is suitably arranged and adapted to provide bearing support to said balancer.

4. The guide system as recited in claim 1, wherein each said wear plate is a combination bearing functioning as both a hydrostatic and hydrodynamic bearing;

at least one said combination bearing secured to said guide rail, at least one said one combination bearing being adapted and configured for being disposed in facing and bearing relationship to said balancer.

5. The guide system as recited in claim 4, wherein each said combination bearing further comprises:

a pad having a recess formed therein at a side thereof configured for facing said balancer.

6. The guide system as recited in claim 5, further comprises:

a means for supplying fluid to the respective recess of each respective said pad.

7. The guide system as recited in claim 6, wherein said means for supplying fluid further comprises:

at least one fluid passageway formed in said guide rail.

8. The guide system as recited in claim 1, wherein said machine is a press machine having a crown, said guide system further comprising:

a connector adapted to connect said guide rail to said crown.

9. The guide system as recited in claim 1, wherein said machine is a press machine.

10. A system for use with a machine having a movable balancer, said system comprising:

a stationary guide member, said guide member being arranged with respect to said balancer so as to thereby facilitate guiding of said balancer; and at least one bearing support member attached to said guide member, at least one said bearing support member being disposed proximate said balancer in a facing and bearing relationship thereto, said at least one said bearing support member thereby acting as a bearing support for said balancer.

11. The system as recited in claim 10, wherein said guide member being adapted and configured to facilitate guiding of said balancer as said balancer operatively slidingly moves relative thereto.

12. The system as recited in claim 10, wherein said guide member being adapted and configured to enable location thereof within a balancer channel formed in said balancer.

13. The system as recited in claim 12, wherein said guide member being adapted to extend commensurate with the balancer channel along a direction substantially parallel with a direction defining a path of movement of said balancer.

14. The system as recited in claim 10, wherein said guide member includes an upright portion being adapted to extend at least in part along a dimension substantially parallel with a dimension defining a path of travel for said balancer.

15. The system as recited in claim 14, wherein the upright portion of said guide member being adapted and configured to enable location thereof within a vertical channel formed in said balancer.

16. The system as recited in claim 10, wherein said guide member has at least one portion defining a rail configuration.

17. The system as recited in claim 10, wherein each said bearing support member includes a respective plate element.

18. The system as recited in claim 10, further comprises:

at least one hydrodynamic/hydrostatic bearing secured to said guide member at locations different from said at least one bearing support member, at least one said hydrodynamic/hydrostatic bearing being adapted and configured for being disposed in facing and bearing relationship to said balancer.

19. The system as recited in claim 18, wherein each said hydrodynamic/hydrostatic bearing further comprises:

a pad having a recess formed therein at a side thereof configured for facing said balancer.

20. The system as recited in claim 19, further comprises:

a means for supplying fluid to the respective recess of each respective said pad.

21. The system as recited in claim 20, wherein said means for supplying fluid further comprises:

at least one fluid passageway formed in said guide member.

22. The system as recited in claim 10, wherein said guide member has a first side surface and a second side surface disposed opposite one another, each said bearing support member being mounted to a respective one of the first side surface and the second side surface of said guide member.

23. The system as recited in claim 22, further comprises:

at least one hydrodynamic/hydrostatic bearing mounted to said guide member, each hydrodynamic/hydrostatic bearing being configured for being disposed in facing and bearing relationship to said balancer, each said hydrodynamic/hydrostatic bearing being mounted to said guide member at a respective surface thereof extending between the first side surface and the second side surface thereof.

24. The system as recited in claim 10, further comprises:

a connector adapted to connect said guide member to a crown portion of said machine, said machine being a press machine.

25. The system as recited in claim 10, wherein said machine is a press machine.

26. The system as recited in claim 10, wherein said guide member is adapted to be removed as an integral unit from said machine, in a manner simultaneously allowing said balancer to remain mounted within said machine.

27. The system as recited in claim 10, further comprises:

at least one auxiliary guide element configured for being disposed apart from and opposite said guide member, each said auxiliary guide element being adapted to facilitate guiding of said balancer during operative movement thereof.

28. A system for use with a machine having a movable balancer, said system comprising:

a stationary guide means for operatively facilitating guided movement of said balancer, said guide means including a guideway structure; and a bearing means for providing bearing support to said balancer, said bearing means being attached to said guide means, said bearing means being in a facing and bearing relationship to said balancer.

29. The system as recited in claim 28, wherein the guideway structure of said guide means being adapted and configured to enable location thereof within a vertical channel formed in said balancer.

30. The system as recited in claim 28, wherein said bearing means further comprises:

a plurality of plate members mounted to said guide means.

31. The system as recited in claim 28, further comprises:

a plurality of hydrodynamic/hydrostatic bearing elements mounted to said guide means, each hydrodynamic/hydrostatic bearing element including a pad having a recess formed therein at a side thereof configured for being facing said balancer; and a fluid supply assembly arranged to provide fluid to said plurality of hydrodynamic/hydrostatic bearing elements.

32. The system as recited in claim 28, wherein said machine is a press machine.

33. An apparatus for use with a press machine having a movable balancer, said apparatus comprising:

a stationary guide rail, said guide rail being disposed at least in part within a vertical channel defined within said balancer; and a plurality of wear plate elements, each said wear plate element being mounted to said guide rail, each said wear plate element thereby being in facing and bearing opposition to said balancer.

34. The apparatus as recited in claim 33, further comprises:

a plurality of hydrodynamic/hydrostatic bearing elements, each said hydrodynamic/hydrostatic bearing element being mounted to said guide rail, each said hydrodynamic/hydrostatic bearing element thereby being configured to be in facing and bearing opposition to said balancer.

35. The apparatus as recited in claim 33, wherein said guide rail being adapted to facilitate guiding of said balancer during operative movement thereof.

36. The apparatus as recited in claim 33, wherein each wear plate element respectively includes at least one bearing surface, each said bearing surface being adapted and arranged and configured for bearing and supporting said balancer.

37. An apparatus for use with a press machine having a movable balancer, said apparatus comprising:

a stationary guide rail, said guide rail guiding said balancer during operative movement thereof; and a plurality of wear plate elements, each said wear plate element being mounted to said guide rail, each said wear plate element thereby being in facing and bearing opposition to said balancer.

38. The apparatus as recited in claim 37, wherein said guide rail is adapted and configured and positioned so as to be disposed at least in part within a vertical channel defined in said balancer.

39. The apparatus as recited in claim 37, wherein each wear plate element respectively includes at least one bearing surface, each said bearing surface being adapted and arranged and configured to provide bearing support to said balancer.

40. The apparatus as recited in claim 37, further comprises:

a plurality of hydrodynamic/hydrostatic bearing members, each said hydrodynamic/hydrostatic bearing member being mounted to said guide rail, each said hydrodynamic/hydrostatic bearing member thereby being adapted and configured so as to be in facing and bearing opposition to said balancer.

41. The apparatus as recited in claim 40, wherein each said hydrodynamic/hydrostatic bearing member further comprises:

a pad having a recess formed therein at a side thereof configured for being facing said balancer.

42. The apparatus as recited in claim 41, further comprises:

a means for supplying fluid to the respective recess of each respective said pad, said means for supplying fluid including an orifice integral with one said wear plate element.

* * * * *